US006684440B1

(12) United States Patent
Wise et al.

(10) Patent No.: US 6,684,440 B1
(45) Date of Patent: Feb. 3, 2004

(54) THREE DIMENSIONAL FABRIC CARE BAG THAT RESISTS COLLAPSING DURING USE

(75) Inventors: Rodney Mahlon Wise, deceased, late of Cincinnati, OH (US), by Linda Wise, legal representative; Thomas Charles Hortel, Cincinnati, OH (US); George Carl Kinstedt, West Chester, OH (US)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/868,344

(22) Filed: Jun. 15, 2001

Related U.S. Application Data

(60) Provisional application No. 60/113,307, filed on Dec. 22, 1998.

(51) Int. Cl.[7] ..... D06F 43/00

(52) U.S. Cl. ..... 8/158; 8/137; 8/142; 68/235

(58) Field of Search ..... 8/137, 142, 158; 68/235; 510/295, 297, 515, 519; 383/117, 211, 82, 86, 88, 89, 99, 100, 102, 103

(56) References Cited

U.S. PATENT DOCUMENTS

| | | | |
|---|---|---|---|
| 1,538,022 | A | 5/1925 | Brekke et al. |
| 1,616,572 | A | 2/1927 | Conway et al. |
| D189,342 | S | 11/1960 | Lucchino et al. |
| D205,489 | S | 8/1966 | Nagy et al. |
| D213,580 | S | 3/1969 | Osborne et al. |
| D215,343 | S | 9/1969 | Christie et al. |
| D269,646 | S | 7/1983 | Schaer |
| 4,944,604 | A | 7/1990 | Myklebust et al. |
| 4,974,967 | A | 12/1990 | Tsuyoshi et al. |
| D340,963 | S | 11/1993 | Hall |
| D348,754 | S | 7/1994 | Feller |
| D363,254 | S | 10/1995 | McGranaghan |
| 5,540,501 | A | 7/1996 | Franco |
| D383,265 | S | 9/1997 | Gable et al. |
| 5,762,648 | A | 6/1998 | Yeazell et al. |
| 5,770,284 | A | 6/1998 | Logemann et al. |
| D411,671 | S | 6/1999 | Hamblin et al. |
| D452,353 | S | 12/2001 | Wise et al. |
| 6,381,870 | B1 | 5/2002 | Kohlman et al. |
| 2002/0112365 | A1 | 8/2002 | Kohlman et al. |

FOREIGN PATENT DOCUMENTS

| | | | |
|---|---|---|---|
| GB | 2302553 | * | 1/1997 |
| WO | WO 97/27354 A1 | | 7/1997 |
| WO | WO 97/41291 A1 | | 11/1997 |
| WO | WO 00/37733 | | 6/2000 |
| WO | WO 01/71088 | | 1/2002 |

* cited by examiner

*Primary Examiner*—Frankie L. Stinson
(74) *Attorney, Agent, or Firm*—Caroline Wei-Berk; C. Brant Cook; Kim W. Zerby

(57) ABSTRACT

A vapor-venting containment bag having at least three flexible side walls and a VVE rating of at least about 40 and less than about 90, as measured in the Vapor Venting Evaluation Test. When the bag is in its closed configuration a three dimensional interior void space is formed whereby the bag resists collapsing. Also, a fabric cleaning and refreshment process that is conducted in a hot air clothes dryer using the vapor-releasing containment bag. The bag is constructed using heat resistant polymers, such as nylon. The bag retains its integrity and can be re-used in subsequent dry cleaning operations. Vapor is vented from the bag during use, thereby minimizing wrinkling in the clothes being cleaned and removing malodors therefrom.

19 Claims, 5 Drawing Sheets

THREE DIMENSIONAL FABRIC CARE BAG THAT RESISTS COLLAPSING DURING USE

This application claims the benefit of Provisional application No. 60/113,307 filed Dec. 22, 1998.

FIELD OF THE INVENTION

The present invention relates to improved bag-type containers for use in a non-immersion fabric care process for dry clean only fabrics. The bags resist collapsing because they have more than two sides whereby a three dimensional interior void space is formed. The bags of this invention are used in fabric care or "refreshment" processes are conducted in a hot air environment in the presence of a cleaning/refreshment composition.

BACKGROUND OF THE INVENTION

Certain delicate fabrics are not suitable for conventional in-home immersion cleaning processes. Home washing machines, which provide excellent cleaning results for the majority of fabrics used in today's society, can, under certain conditions, shrink or otherwise damage silk, linen, wool and other delicate fabrics. Consumers typically have their delicate fabric items "dry-cleaned". Unfortunately, dry-cleaning usually involves immersing the fabrics in various hydrocarbon and halocarbon solvents that require special handling and must be reclaimed, making the process unsuitable for in-home use. Hence, dry-cieaning has traditionally been restricted to commercial establishments making it less convenient and more costly than in-home laundering processes. But, excluding cost and convenience, dry-cleaning processes remain generally superior to in-home, immersion laundering processes for the care of fine fabrics.

Attempts have been made to provide in-home dry-cleaning systems that combine the fabric cleaning and refreshing of in-home, immersion laundering processes with the fabric care benefits of dry-cleaning processes. One such in-home system for cleaning and refreshing garments comprises a substrate sheet containing various liquid or gelled cleaning agents, and a plastic bag. The garments are placed in the bag together with the sheet, and then tumbled in a conventional clothes dryer. In a current commercial embodiment, multiple single-use flat sheets comprising a cleaning/refreshing agent and a single multi-use plastic bag are provided in a package. The bags used in such in-home processes are typically two sided and closed in an "envelope" fashion. Unfortunately, the two sided, envelope style bag is sub-optimal with respect to cleaning and refreshing fine fabrics.

To be clear, these in-home, non-ininersion processes are substantially superior to in-home, immersion processes with respect to cleaning and refreshing fine fabrics But the envelope style bags used in these in-home, non-immersion processes tend to collapse around the fabric articles being cleaned and refreshed. The envelope style bags billow slightly when steam is generated inside the bag as the cleaning refreshment composition is vaporized. But current bags provide only minimal interior void space within which the fabric articles can tumble. Thus, there is a continuing need to find improved containment bags for use in in-home, non-immersion cleaning and refreshing processes. Preferably, these improved containment bags resist collapsing and provide a larger interior void space within which the fabric articles can tumble freely. By allowing the fabric articles to tumble freely, wrinkle removal is improved and wrinkle resistance/prevention is enhanced as compared to the current conventional bags.

The present invention provides such a containment bag, and when used in the processes of this invention, and with the kits of this invention, the cleaning and refreshing of fine fabrics is improved.

SUMMARY OF THE INVENTION

In one embodiment, the present invention provides a vapor-venting containment bag comprising:

i) an open configuration and a closed configuration;

ii) a VVE rating of at least about 40, preferably at least about 60 and less than about 90, preferably less than about 80, as measured in the Vapor Venting Evaluation Test.

When the bag is in its closed configuration the bag comprises at least three flexible side walls. Further, when the bag is in its closed configuration a three dimensional interior void space is formed whereby the bag resists collapsing. Preferably, the bag comprises at least four side walls configured in the form of a tetrahedron. In another aspect, the bag comprises at least six side walls configured in the form of a cube.

In yet another aspect of this invention there is provided a process for cleaning or refreshing fabrics by contacting the fabrics with a fabric cleaning/refreshment composition comprising water in a vapor-venting containment bag as described above. In one preferred embodiment, the process is carried out in a hot air clothes dryer at a temperature from about 40° C. to about 150° C., whereby malodors present on the fabrics are vented from the bag by means of the vapor-venting closure.

There is also provided herein a kit for cleaning or refreshing fabrics, comprising a package that contains one or more absorbent articles comprising a carrier which releasably contains water and optional non-water fabric cleaning/refreshment ingredients, and a vapor-venting containment bag as described above. In a preferred embodiment, the kit further comprises from one to about ten of the absorbent articles which are disposable after a single use.

All percentages, ratios and proportions herein are by weight, unless otherwise specified. All documents cited are, in relevant part, incorporated herein by reference.

It has now been unexpectedly discovered that certain bags, specifically, those with more than two side walls, form a three dimensional interior void space when they are closed. This three dimensional void space allows the bag to resist collapsing on the fabric articles that are treated within the bag. That is, the bag retains its "billowed" configuration better than conventional envelope style bags. Even more surprisingly, the bags of this invention, by virtue of their enhanced three dimensional configuration, tumble more efficiently in a conventional clothes dryer. Specifically, the bags tend to maintain a position in the center of the tumbling drum of a clothes dryer resisting the centrifugal forces that tend to pull common envelope style bags to the side walls of the drum where they collapse. By virtue of their design, the bags of this invention tend to maintain their three dimensional shape such that the fabric articles inside the bag are free to tumble, while at the same time being in the controlled environment of a vapor venting bag.

BRIEF DESCRIPTION OF THE DRAWINGS

While this specification concludes with claims that distinctly define the present invention, it is believed that these claims can be better understood by reference to the Detailed Description Of The Invention and the drawings, wherein:

DETAILED DESCRIPTION OF THE INVENTION

Figure 1:
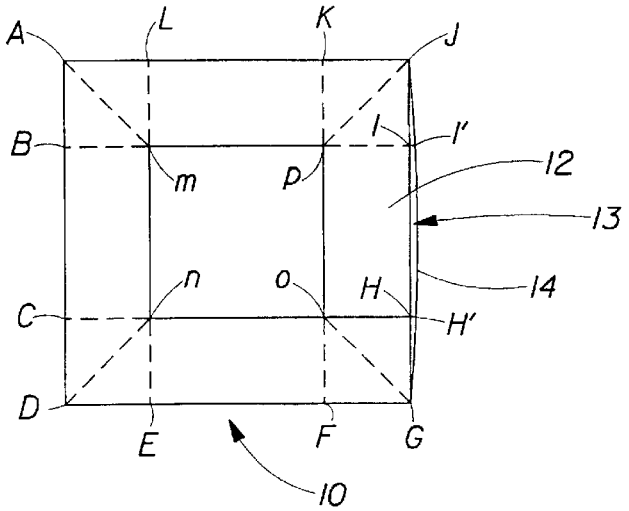
FIG. 1 is a schematic representation of a conventional two sided envelope style bag with fold lines.

It will be appreciated from the disclosures herein that the present invention provides the user with a three dimensional bag that can be used for cleaning and refreshing fabrics, especially garments, in a simple, readily available apparatus such as a conventional hot air clothes dryer. The bags and processes of the invention can be used with any type of fabric/garment, including "Dry Clean Only" (DCO) garments. In a preferred embodiment, the user is provided with an article which comprises an absorbent core which releasably contains a cleaning/refreshment composition. In one embodiment, this core with its load of liquid composition is substantially enrobed in an outer cover sheet, which has openings through which the composition is permeable in the vapor state, but which constitutes a barrier through which liquid can flow in, but would be somewhat restrained in the core against flow outward. The liquid-loaded core can also be enrobed in low-density non-water absorbent woven or non-woven sheet comprising fibers such as nylon, polyester, polypropylene and the like. In addition, the user can, optionally, also be provided with a separate portion of a spot removal ("pre-spotting") composition.

When treating a fabric (such as a soiled, wrinkled or malodorous garment) in the present manner, the item is first inspected for heavily spotted areas. If none are found, the item being treated is placed in the vapor-venting containment bag of this invention together with the cleaning/refreshment article herein and tumbled in a hot air clothes dryer in the manner disclosed, i.e., the "in-dryer" step.

If heavily spotted areas are found, it is preferred to treat them individually before the in-dryer step. The pre-spotting steps of this invention are discussed in detail below.

Containment Bag

It has now been discovered that high water content compositions can be loaded onto a carrier substrate such as a cloth or woven or non-woven towelette and placed in a bag environment in a heated operating clothes dryer, or the like, to remove malodors from fabrics as a dry cleaning alternative or "fabric refreshment" process. The warm, humid environment created inside this bag volatilizes malodor components in the manner of a "steam distillation" process, and moistens fabrics and the soils thereon. This moistening of fabrics can loosen pre-set wrinkles, but overly wet fabrics can experience setting of new wrinkles during the drying stage toward the end of the dryer cycle. Proper selection of the amount of water used in the process and, importantly, proper venting of the bag in the present manner can minimize wrinkling. Moreover, if the bag is not vented, the volatilized malodorous materials removed from the fabrics can undesirably be re-deposited thereon.

The design of the venting ability of the bag achieves a proper balance of the above effects. A tightly-sealed, vapor impermeable "closed" bag will not purge malodors and will overly moisten the fabrics, resulting in wrinkling. An overly "open" bag design will not sufficiently moisten the fabrics or soils to mobilize heavier malodors or to remove pre-existing fabric wrinkles. Further, the bag must be "closed" enough to billow and create a void volume under water vapor pressure, wherein the fabrics can tumble freely within the bag and be exposed to the vapors. By allowing the fabric articles to tumble freely, wrinkle removal is improved and wrinkle resistance/prevention is enhanced.

The bag must be designed with sufficient venting to trap a portion of water vapors (especially early in the dryer cycle) but to allow most of the water to escape by the end of the cycle. Said another way, the rate of vapor release is, preferably, optimized to secure a balance of vapor venting and vapor trapping. A preferred bag design employs a water vapor impermeable film such as nylon, with a the closure flap (preferably with a hook-and-loop VELCRO®-type fastener) like that of a large envelope. The degree of slack in the fold-over portion of the closure flap can be varied to provide a vapor-venting air gap or partial opening which controls the rate of vapor venting from of the bag.

The fabrics, when removed from the bag, will usually contain a certain amount of moisture. This will vary by fabric type. For example, silk treated in the optimal range shown on the graph may contain from about 0.5% to about 2.5%, by weight, of moisture. Wool may contain from up to about 4%, by weight, of moisture. Rayon also may contain up to about 4% moisture. This is not to say that the fabrics are, necessarily, frankly "damp" to the touch. Rather, the fabrics may feel cool, or cool-damp due to evaporative water losses. The fabrics thus secured may be hung to further air dry, thereby preventing wrinkles from being re-established. The fabrics can be ironed or subjected to other finishing processes, according to the desires of the user.

The present invention thus provides three dimensional vapor-venting containment bags which are intended for use in a fabric cleaning/refreshment operation. The bags are preferably designed for multiple uses and reuses, and are especially adapted for use by the consumer in any conventional hot air clothes dryer apparatus, such as those found in the home or in commercial laundry/cleaning establishments. The bags herein are specifically designed to vent water and other vapors which emanate from within the bag when used in the manner described herein. The vapors released from the bag are exhausted through the air vent of the dryer apparatus.

As described more fully below, the preferred bags are provided with a vapor-venting closure which provides one or more gaps through which vapors are released from the bag, in-use. In a preferred embodiment, the size of this gap is selected to provide controlled vapor release from the bag under the indicated operating conditions. While other gap sizes and operating conditions can be used, a preferred balance between vapor containment within the bag to perform the cleaning/refreshment function and vapor release from the bag has now been determined using the principles disclosed hereinafter.

Alternatively, the bag can be provided with a series of holes or other fenestrations which provide vapor venting. However, such venting is not as effective as the vapor-venting closure.

In one embodiment, the present invention encompasses a vapor-venting containment bag comprising an open end, a closed end and at least three flexible side walls having inner and outer surfaces, the open end of the bag having a section of one side wall extending beyond the open end to provide a flexible flap, the flap having first fastening device affixed thereto, the flap being foldable to extend over a portion of the outside surface of the opposing side wall, the flap being affixable to the outer surface of the opposing wall of the bag by engaging the first fastening device on the inside face of the flap with a second fastening device present on the outside face of the opposing side wall, the first and second fastening devices, when thus engaged, forming a fastener, thereby providing a closure for the open end of the bag. The first and second fastening devices are disposed so as, when engaged, to provide vapor-venting along the closure, especially at the lateral edges of the closure. The first and second fastening devices can form a mechanical fastener or an adhesive fastener. The bag herein is most preferably formed from film which is heat resistant up to at least about 204° C.–260° C. Nylon is a preferred film material for forming the bag, polyester is also preferred. In another embodiment, the edge of one wall of the bag is notched along a substantial portion of its width to facilitate and optimize vapor venting.

In an alternate mode, the flap can be folded to provide the closure, tucked inside the opposing side wall, and secured there by a fastener. In this mode, vapors are vented along the closure and especially at the lateral edges of the closure. In yet another mode, the side walls are of the same size and no flap is provided. Fastening devices placed intermittently along portions of the inner surfaces of the side walls are engaged when the lips of the side walls are pressed together to provide closure. One or more vapor-venting gaps are formed in those regions of the closure where no fastening device is present.

While the fastening devices herein can comprise chemical adhesives, the bag is preferably designed for multiple uses. Accordingly, reusable mechanical fasteners are preferred for use herein. Any reusable mechanical fastener or fastening means can be used, as long as the elements of the fastener can be arranged so that, when the bag is closed and the fastener is engaged, a vapor-venting closure is provided. Non-limiting examples include: bags wherein the first and second fastening devices, together, comprise a hook and loop (VELCRO®-type) fastener; hook fasteners such as described in U.S. Pat. No. 5,058,247 to Thomas & Blaney issued Oct. 22, 1991; bags wherein the first and second fastening devices, together, comprise a hook and string type fastener; bags wherein the first and second fastener devices, together, comprise an adhesive fastener; bags wherein the first and second fastening devices, together, comprise a toggle-type fastener; bags wherein the first and second fastening devices, together, form a snap-type fastener; as well as hook and eye fasteners, ZIP LOK®-style fasteners, zipper-type fasteners, and the like, so long as the fasteners are situated so that vapor venting is achieved. Other fasteners can be employed, so long as the vapor-venting is maintained when the bag is closed, and the fastener is sufficiently robust that the flap does not open as the bag and its contents are being tumbled in the clothes dryer. The fastening devices can be situated that the multiple vapor-venting gaps are formed along the closure, or at the lateral edges, or so that the gap is offset to one end of the closure.

Turning now to the drawings wherein FIG. 1 is a schematic representation of a conventional two sided envelope style bag 10 with fold lines inscribed thereon. Letters A–P have been used to indicate fold lines and intersection points on side wall 12 of bag 10. The points on the opposite side wall 14 of envelope bag 10, which correspond to the interior points M, N, O and P are labeled M', N', O' and P', respectively. Envelope bag 10 is sealed along edges ALKJ, ABCD and DEFG. Edges JIHG and JI'H'G are a part of side walls 12 and 14, respectively, and these edges define bag opening 13.

Figure 2:
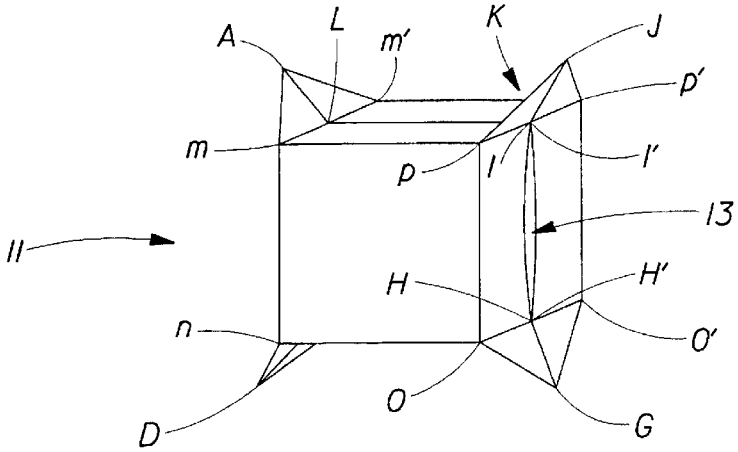
FIG. 2 is a schematic representation of the bag of FIG. 1 after it has been folded along the marked fold lines to form a six sided cube.

When bag 10 is folded along the lines shown (for example, lines LMNE, AM, and CNOH) a six sided cube is formed as shown in FIG. 2 as bag 11. It is highly preferred that the edge lines MM', NN', OO' and PP' be sealed, for example either mechanically or adhesively so that the bag maintains its cube-like configuration. The triangular shaped tips (for example, AMM' and JPP') can be removed or they can be folded against one of the side walls. Alternatively, the triangular shaped tips can be left sticking out to help bag 11 align within the rotary drum of a conventional dryer as shown in FIG. 3.

Figure 3:
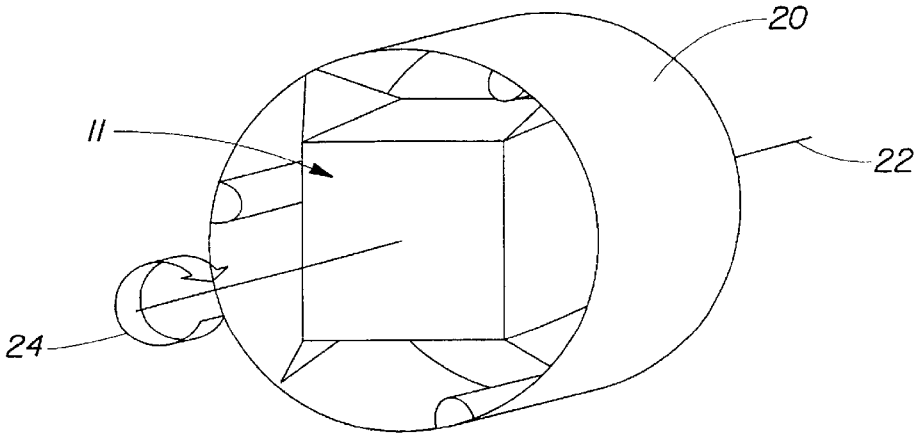
FIG. 3 is a schematic representation of the bag of FIG. 2 inside a rotating drum of a conventional clothes dryer.

Specifically, FIG. 3 shows a six sided bag 11 according to this invention inside of a rotary drum 20 of a conventional clothes dryer (not shown). While not wanting to be bound by any one theory, it is believed that bag 11 and rotary drum 20 both rotate about axis 22 as illustrated by arrow 24. This is in sharp contrast to a conventional envelope style bag which is believed to by drawn to the side walls of the rotary drum by centrifugal forces created as the drum spins about its axis. Once pressed against the side of the drum, an envelope style bag is prone to collapsing. This in turn restricts the interior space of the bag within which the fabric articles have to tumble. As discussed above, a collapsed bag provides sub-optimal cleaning and refreshing for fabric articles.

Figure 4:
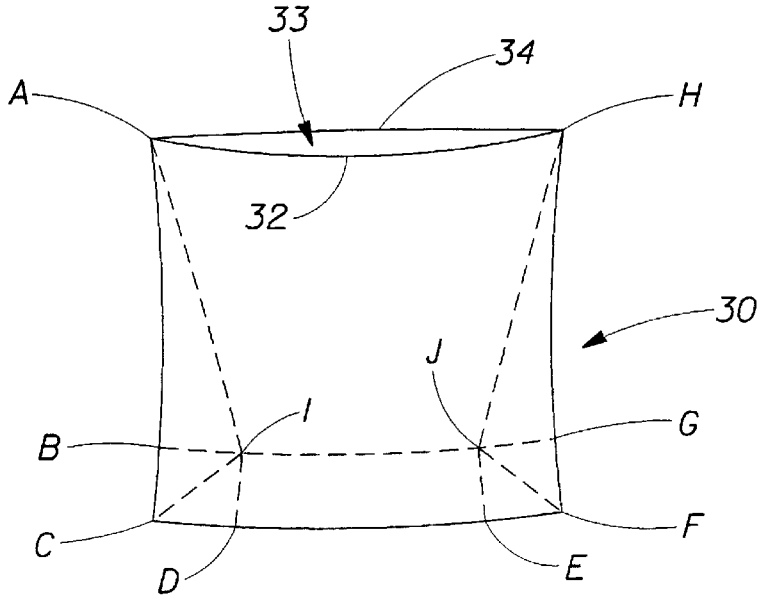
FIG. 4 is a schematic representation of a conventional two sided envelope style bag with fold lines.

FIG. 4 is a schematic representation of a conventional two sided envelope style bag 30 with fold lines inscribed thereon. Letters A–J have been used to indicate fold lines and intersection points on side wall 32 of bag 30. The points on the opposite side wall 34 of envelope bag 30, which correspond to the interior points I and J are labeled I' and J', respectively. Envelope bag 30 is sealed along edges ABC, CDEF and FGH. There are two edges AH, which are part of side walls 32 and 34, respectively, and these edges define bag opening 33.

Figure 5:
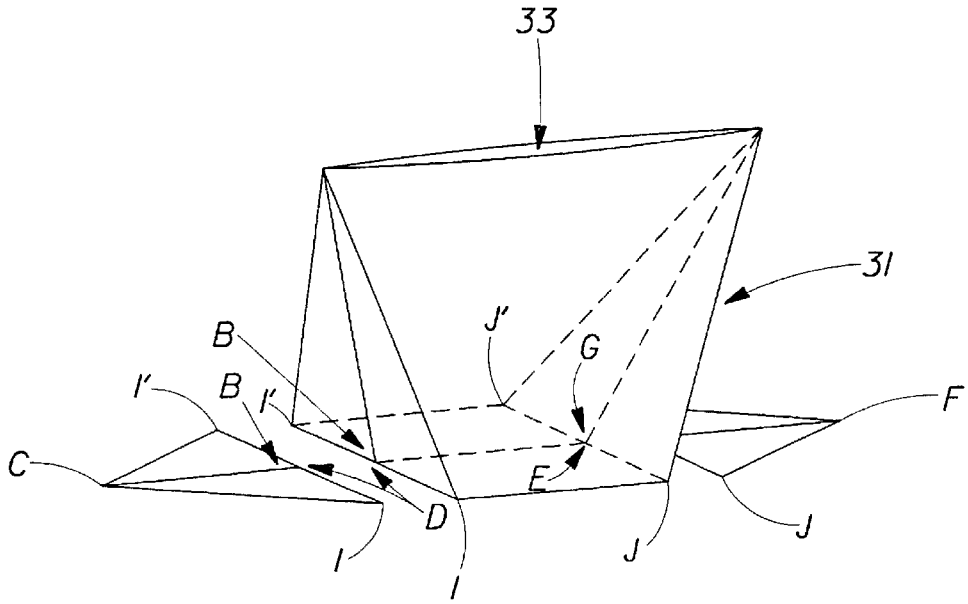
FIG. 5 is a schematic representation of the bag of FIG. 4 after it has been folded along the marked fold lines to form a five sided three dimensional bag.

When bag 30 is folded along the lines shown (for example, lines AID and CI) a five sided bag 31 is formed as shown in FIG. 5. It is highly preferred that the edge lines II' and JJ' be sealed, for example, either mechanically or adhesively, so that the bag maintains its three dimensional configuration. The triangular shaped tips (CII' and FJJ') can be removed as shown or they can be folded against one of the side walls. Alternatively, the triangular shaped tips can be left sticking out to help the bag align within the rotary drum of a conventional dryer.

Figure 6:
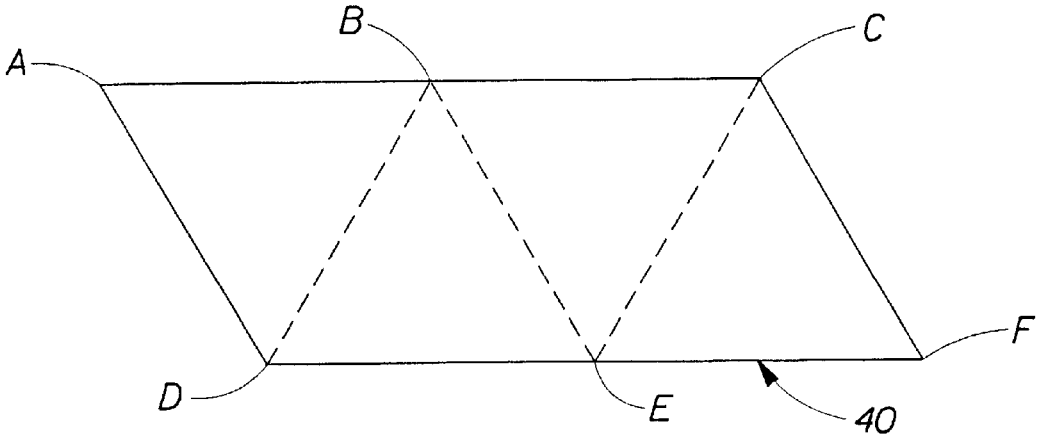
FIG. 6 is a schematic representation of a sheet of bag material with fold lines.
Figure 7:
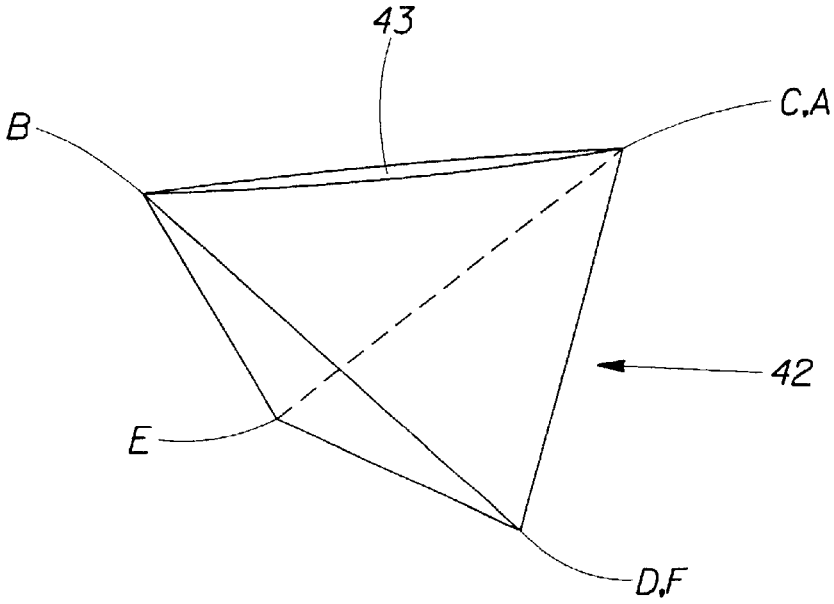
FIG. 7 is a schematic representation of the sheet of FIG. 6 after it has been folded along the marked fold lines to form a four sided three dimensional bag.
Figure 8:
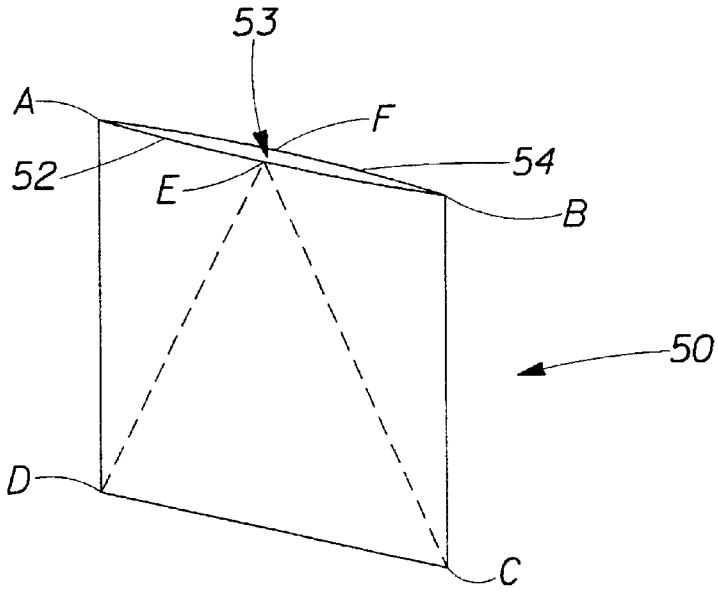
FIG. 8 is a schematic representation of a conventional two sided envelope style bag with fold lines.

FIG. 6 is a schematic representation of a sheet 40 of bag material with fold lines inscribed thereon. Letters A–F have been used to indicate fold lines and intersection points on sheet 40. Sheet 40 is folded along lines DB, BL and EC, then edges ED and EF are sealed together, and edges AD and CF are sealed together to form a tetrahedral bag 42, as shown in FIG. 7. Edges BC and BA define bag opening 43, as shown in FIG. 7.

Figure 9:
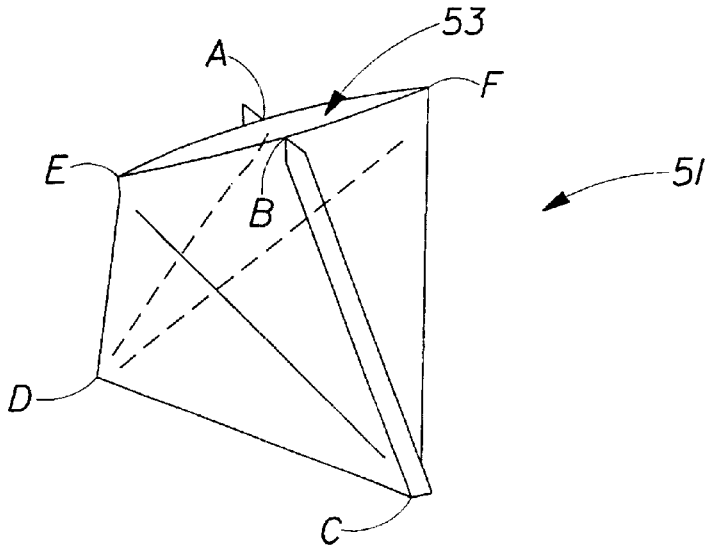
FIG. 9 is a schematic representation of the bag of FIG. 8 after it has been folded along the marked fold lines to form a four sided three dimensional bag.

FIG. 9 is a schematic representation of a conventional two sided envelope style bag 50 with fold lines inscribed thereon. Letters A–F have been used to indicate fold lines and intersection points on side walls 52 and 54 of bag 50. The fold lines present on side wall 52 are EC and ED. Analogous fold lines are present on side wall 54; namely, F–C and F–D. Envelope bag 50 is sealed along edges AD, DC and SC. There are two edges AEB and AFB, which are part of side walls 52 and 54, respectively, and these edges define bag opening 53. When bag 50 is folded along the lines shown (for example, lines ED and EF) a tetrahedral bag 51 is formed as shown in FIG. 9.

Figure 10:
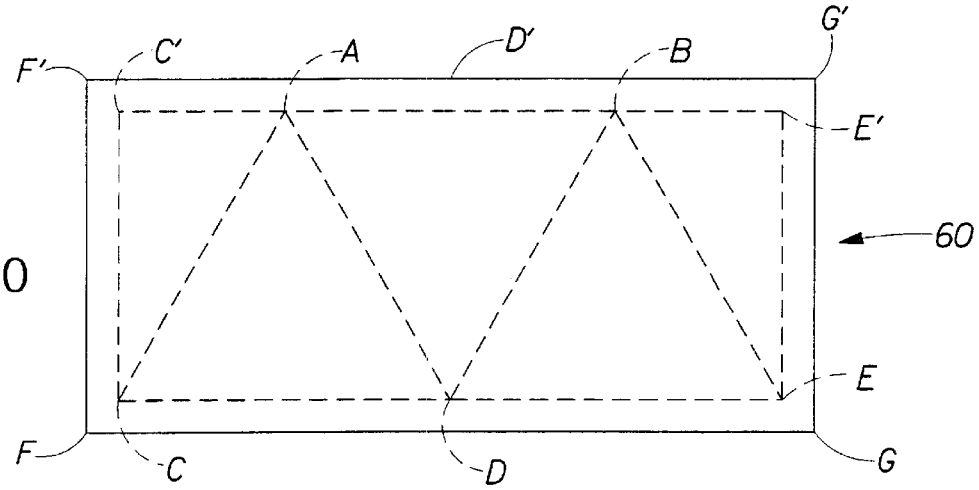
FIG. 10 is a schematic representation of a sheet of bag material with fold lines.

FIG. 10 is a schematic representation of a sheet 60 of bag material with fold lines inscribed thereon. Letters A–G, C', E', F', and G' have been used to indicate fold lines and intersection points on sheet 60. Letter D' has been used to indicate a mid-point on edge F'G'.

Figure 11:
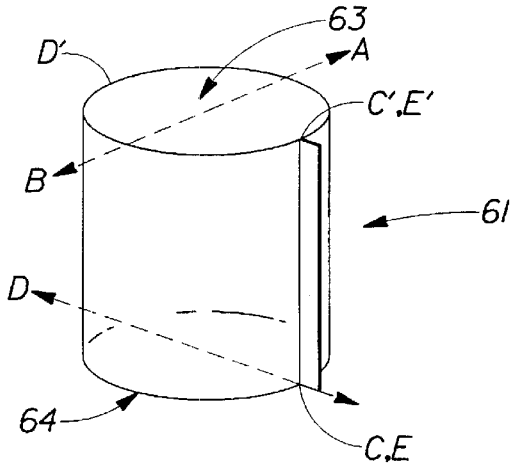
FIG. 11 is a schematic representation of the sheet of FIG. 10 after it has been formed into a cylinder.

As shown in FIG. 11, the sheet 60 can be formed into a cylinder shape 61 by contacting and preferably sealing fold line EE' to fold line CC' such that a fold line between point CE and C'E' is formed.

Figure 12:
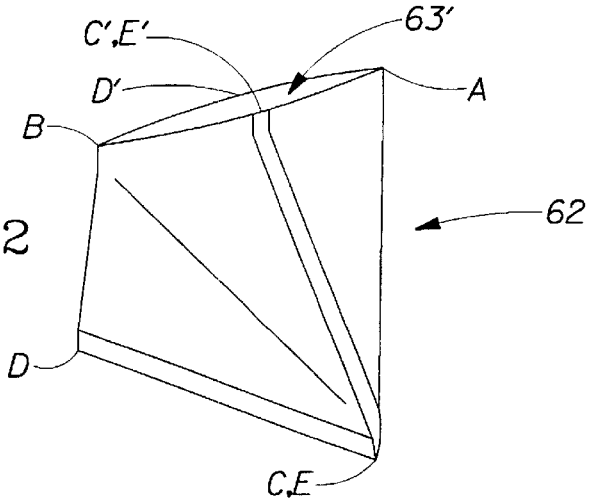
FIG. 12 is a schematic representation of the cylinder of FIG. 11 and ultimately the sheet of FIG. 10 after it has been folded along the marked fold lines to form a four sided three dimensional bag.

An example of one method for forming the tetrahedral bag 62, as shown in FIG. 12, is by forming the cylinder 61, as shown in FIG. 11. The cylinder 61 comprises a first opening 63 and a second opening 64. The second opening 64 is closed by sealing along seal line DC–E. After forming seal DC–E, the cylinder 61 is stretched along stretch line BA such that point D' and C'–E'about come in contact with each other, such that the bag opening 63' of the tetrahedral bag 62 is formed by edges BC'–E'A and BD'A. This method substantially produces the tetrahedral bag 62, as shown in FIG. 12.

Another example of a method for forming the tetrahedral bag 62, as shown in FIG. 12, is by folding the sheet 60 along fold lines CA, AD, DB, BE, then fold lines CC' and EE' are sealed together and fold lines CD and DE are sealed together to form the tetrahedral bag 62. Edges BC'–E'A and BD'A define bag opening 63', as shown in FIG. 12.

The construction of the preferred, heat-resistant vapor-venting bags used herein to contain the fabrics in a hot air laundry dryer or similar device preferably employs thermal resistant films to provide the needed temperature resistance to internal self-sling and external surface deformation sometimes caused by overheated clothes dryers. In addition, the bags are resistant to the chemical agents used in the cleaning or refreshment compositions herein. By proper selection of bag material, unacceptable results such as bag melting, melted holes in bags, and sealing of bag wall-to-wall are avoided. In a preferred mode, the fastener is also constructed of a then resistant material. As shown in FIG. 6, in one embodiment, 1 to 3 mil (0.025–0.076 mm) heat-resistant Nylon-6 film having fold lines scribed thereon is folded and scaled into a containment bag. Sealing can be done using standard impulse heating equipment In an alternate mode, a sheet of nylon is simply folded in half and sealed along two of its edges. In yet another mode, bags can be made by air blowing operations The method of assembling the bags can be varied, depending on the equipment available to the manufacturer and is not critical to the practice of the invention.

The dimensions of the containment bag can vary, depending on the intended end-use. For example, a relatively smaller bag can be provided which is sufficient to contain one or two silk blouses. Alternatively, a larger bag suitable for handling a man's suit can be provided. Typically, the bags herein will have an internal volume of from about 10,000 $cm^3$ to about 25,000 $cm^3$. Bags in this size range are sufficient to accommodate a reasonable load of fabrics (e.g., 0.2–5 kg) without being so large as to block dryer vents in most U.S.-style home dryers. Somewhat smaller bags may be used in relatively smaller European and Japanese dryers.

The bags herein are preferably flexible, yet are preferably durable enough to withstand multiple uses. The bags also preferably have sufficient stiffness that they can billow, in-use, thereby allowing its contents to tumble freely within the bag during use. Typically, such bags are prepared from 0.025 mm to 0.076 mm (1–3 mil) thickness polymer sheets. If more rigidity in the bag is desired, somewhat thicker sheets can be used.

In addition to thermally stable "nylon-only" bags, the containment bags herein can also be prepared using sheets of co-extruded nylon and/or polyester or nylon and/or polyester outer and/or inner layers surrounding a less thermally suitable inner core such as polypropylene. In an alternate mode, a bag is constructed using a nonwoven outer "shell" comprising a heat-resistant material such as nylon or polyethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400–500° F. (204° C. to 60° C.). Under circumstances where excessive heating is not of concern, the bag can be made of polyester, polypropylene or any convenient polymer material.

Vapor Venting Evaluation

In its broadest sense, the preferred vapor-venting containment bag used in this invention is designed to be able to vent at least about 40%, preferably at least about 60%, up to about 90%, preferably no more than about 80%, by weight, of the total moisture introduced into the bag within the operating cycle of the clothes dryer or other hot air apparatus used in the process herein. (Of course most, if not all, of organic cleaning solvents, if any, will also be vented during use together with the water. However, since water comprises by far the major portion of the cleaning/refreshment compositions herein, it is more convenient to measure and report the venting as water vapor venting.)

It will be appreciated by those knowledgeable about the operation of hot air clothes dryers and similar apparatus that the rate of venting will usually not be constant over the entire operating cycle. All dryers have a warn-up period at the beginning of the operating cycle, and this can vary according to the specifications of the manufacturer. Most dryers have a cool-down period at the end of the operating cycle. Some venting from the containment bag can occur during these warm-up and cool-down periods, but its rate is generally less than the venting rate over the main period of the drying cycle. Moreover, even during the main period of the cycle, many modem dryers are constructed with thermostat settings which cause the air temperature in the dryer to be increased and decreased periodically, thereby preventing overheating. Thus, an average, rather than constant, dryer operating temperature in the target range of from about 50° C. to about 85° C. is typically achieved.

Moreover, the user of the present containment bag may choose to stop the operation of the drying apparatus before the cycle has been completed. Some users may wish to secure fabrics which are still slightly damp so that they can be readily ironed, hung up to dry, or subjected to other finishing operations.

Apart from the time period employed, the Vapor-Venting Equilibrium ("VVE") for any given type of vapor-venting closure will depend mainly on the temperature achieved within the dryer—which, as noted above, is typically reported as an average "dryer air temperature". In point of fact, the temperature reached within the containment bag is more significant in this respect, but can be difficult to measure with accuracy. Since the heat transmittal through the walls of the bag is rather efficient due to the thinness of the walls and the tumbling action afforded by conventional clothes dryers, it is a reasonable approximation to measure the VVE with reference to the average dryer air temperature.

Moreover, it will be appreciated that the vapor-venting from the containment bag should not be so rapid that the aqueous cleaning/refreshment composition does not have the opportunity to moisten the fabrics being treated and to mobilize and remove the soils/malodors therefrom. However, this is not of practical concern herein, inasmuch as the delivery of the composition from its carrier substrate onto the fabrics afforded by the tumbling action of the apparatus occurs at such a rate that premature loss of the composition by premature vaporization and venting is not a significant factor. Indeed, the preferred bag herein is designed to prevent such premature venting, thereby allowing the liquid and vapors of the cleaning/refreshment composition to remain within the bag for a period which is sufficiently long to perform its intended functions on the fabrics being treated.

The following Vapor-Venting Evaluation Test (VVET) illustrates the foregoing points in more detail. Larger or smaller containment bags can be used, depending on the volume of the dryer drum, the size of the fabric load, and the like. As noted above, however, in each instance the containment bag is designed to achieve a degree of venting, or VVE "score", of at least about 40% (40 VVE), preferably at least about 60% (60 VVE), up to about 90% (90 VVE).

VAPOR-VENTING EVALUATION TEST

Materials:

Three Dimensional Containment Bag to be evaluated for VVE.

Carrier Substrate (15"×11"; 38.1 cm×27.9 cm) HYDRASPUN®carrier substrate sheet from Dexter with (10444) or without (10244) Binder Wool Blouse: RN77390, Style 12288, Weight approx. 224 grams Silk Blouse: RN40787, Style 0161, Weight approx. 81 grams Rayon Swatch: 45"×17"(114.3 cm×43.2 cm), Weight approx. 60 grams Pouch: 5"×6.375"(12.7 cm×16.2 cm) to contain the Carrier Substrate and water De-ionized Water; Weight is variable to establish VVE.

Pretreatment of Fabrics:

1. The wool, silk, and rayon materials are placed in a Whirlpool dryer (Model LEC7646DQO) for 10 minutes at high heat setting, with the heating cycle ranging from about 140° F.–165° F. to remove moisture picked up at ambient condition.
2. The fabrics are then removed from the dryer and placed in sealed nylon or plastic bags (minimum 3 mil. thickness) to minimize moisture pick up from the atmosphere.

Test Procedure:

1. Water of various measured weights from 0 to about 40 grams is applied to the carrier substrate a minimum of 30 minutes before running a vented bag test. The substrate is folded, placed in a pouch and sealed.
2. Each fabric is weighed separately and the dry weights are recorded. Weights are also recorded for the dry carrier substrate, the dry pouch containing the substrate, and the dry containment bag being evaluated.
3. Each garment is placed in the bag being evaluated for vapor venting along with the water-containing substrate (removed from its pouch and unfolded).
4. The bag is closed without expressing the air and placed in the Whirlpool Dryer for 30 minutes at the high heat setting, with tumbling per the standard mode of operation of the dryer.
5. At the end of 30 minutes the bag is removed from the dryer and each fabric, the carrier substrate, the bag and the pouch are weighed for water weight gain relative to the dry state. (A possible minor loss in weight for the containment bag due to dryer heat is ignored in the calculations.)
6. The weight gain of each garment is recorded as a percent of the total moisture applied to the carrier substrate.
7. The remaining unmeasured moisture divided by the total moisture is recorded as percent vented from the dryer bag.
8. When a series of total applied moisture levels are evaluated, it is seen that above about 15–20 grams of water the % vented becomes essentially constant, and this is the Vapor-Venting Equilibrium value, or VVE, for the particular bag venting design.

It can be seen from examining a series of VVET results at various initial moisture levels that the water at lower initial levels is being disproportionately captured by the garment load, the headspace, and the nylon bag, such that venting of water and volatile malodors begins in earnest only after the VVE value is achieved. Since this occurs only when about 15–20 grams or more of water is initially charged, it is seen that a VVE of greater than about 40 is needed to avoid excessive wetting of garments, leading to unacceptable wet-setting of wrinkles, as discussed herein.

Cleaning And Refreshing Processes

As discussed briefly above, the cleaning and refreshing processes of this invention include the following steps. The cleaning/refreshment composition is loaded on the substrate which is preferably encased in a coversheet, and the substrate is placed in a bag according to this invention with the fabrics to be treated. The bag is closed and placed in a heated operating clothes dryer, or the like, to remove malodors from the fabrics.

In more detail, the cleaning and refreshing process herein can be conducted in the following manner. Modifications of the process can be practiced without departing from the spirit and scope of the present invention.

(i) optionally, conducting a pre-spotting process according to the description below, on localized stained areas of the fabric;

(ii) placing the entire fabric together with the substrate that releasably contains a cleaning/refreshment composition in a three dimensional containment bag;

(iii) placing the bag in a device to provide agitation, e.g., such as in a hot air clothes dryer and operating the dryer with heat and tumbling to moisten the fabric; and (iv) removing the fabric from the bag.

(v) promptly hanging the fabrics to complete drying and/or to prevent re-wrinkling.

More specifically, the cleaning and refreshment process is conveniently conducted in a tumbling apparatus, preferably in the presence of heat. The substrate containing the releasably absorbed shrinkage reducing composition and cleaning/refreshment composition is placed along with the fabrics to be treated in a nylon or other heat-resistant, and preferably vapor-venting bag. The bag is closed and placed in the drum of an automatic hot air clothes dryer at temperatures of 40° C.–150° C. The drum is allowed to revolve, which imparts a tumbling action to the bag and agitation of its contents concurrently with the tumbling. The tumbling and heating are carried out for a period of at least about 10 minutes, typically from about 20 minutes to about 60 minutes. This step can be conducted for longer or shorter periods, depending on such factors as the degree and type of soiling of the fabrics, the nature of the soils, the nature of the fabrics, the fabric load, the amount of heat applied, and the like, according to the needs of the user.

In more detail, a pre-spotting process can be conducted in the following manner. Modifications of the process can be practiced without departing from the spirit and scope of the present invention.

1. Place a stained area of the fabric over and in contact with the poly-HIPE or IBAL stain receiver described herein or, less preferably, an ordinary folded paper towel (e.g., preferably white or non-printed—to avoid dye transfer from the towel—BOUNTY® brand) on any suitable surface such as a table top, in a tray, etc.
2. Apply enough spot cleaning composition from a dispenser bottle with a narrow spout which directs the composition onto the stain (without unnecessarily saturating the surrounding area of the fabric) to saturate the localized stained area—about 10 drops; more may be used for a larger stain.
3. Optionally, let the composition penetrate the stain for 3–5 minutes.
4. Optionally, apply additional composition—about 10 drops; more may be used for larger stains.
5. Use the treatment member, such as the distal tip on the dispenser bottle to work the stain completely out. Contact can be maintained for a period of 1–60 seconds for lighter stains and 1–5 minutes, or longer, for heavier or more persistent stains.
6. Optionally, blot the fabric, e.g., between paper towels, to remove excess composition. Or, the treated area can be blotted with a dampened sponge or other absorbent medium to flush the fibers and remove excess composition.

Cleaning/Refreshment Composition

The cleaning/refreshment composition preferably comprises water and a member selected from the group consisting of surfactants, perfumes, preservatives, bleaches, auxiliary cleaning agents, organic solvents and mixtures thereof. The preferred organic solvents are glycol ethers, specifically, methoxy propoxy propanol, ethoxy propoxy propanol, propoxy propoxy propanol, butoxy propoxy propanol, butoxy propanol and mixtures thereof. The surfactant is preferably a nonionic surfactant, such as an ethoxylated alcohol or ethoxylated alkyl phenol, and is present at up to about 2%, by weight of the cleaning/refreshment composition. Typical fabric cleaning refreshment/compositions herein can comprise at least about 80%, by weight, water, preferably at least about 90%, and more preferably at least about 95% water.

The Examples below give specific ranges for the individual components of preferred cleaning/refreshment compositions for use herein. A more detailed description of the individual components of the cleaning/refreshment compositions, that is, the organic solvents, surfactants, perfumes, preservatives, bleaches and auxiliary cleaning agents can be found in U.S. Pat. No. 5,789,368, which issued on Aug. 4, 1998 to You et al. The entire disclosure of the You et al. patent is incorporated herein by reference. Additionally, cleaning/refreshment compositions are described in co-pending U.S. patent application Ser. No. 08/789,171, which was filed on Jan. 24, 1997, in the name of Trinh et al. The entire disclosure of the Trinh et al. Application is incorporated herein by reference.

It is especially preferred that the cleaning/refreshment compositions of this invention include a shrinkage reducing composition, which is preferably selected from the group consisting of ethylene glycol, all isomers of propanediol, butanediol, pentanediol, hexanediol and mixtures thereof, and more preferably selected from the group consisting of neopentyl glycol, polyethylene glycol, 1,2-propanediol, 1,3-butanediol, 1-octanol and mixtures thereof. The shrinkage reducing composition is preferably neopentyl glycol or 1,2-propanediol, and is more preferably 1,2-propanediol. The ratio of shrinkage reducing composition to cleaning/refreshment composition is preferably from about 1:2 to about 1:5, preferably from about 1:2 to about 1:4, more preferably from about 1:3 to about 1:4, and most preferably about 1:3.6.

Substrate

When used in the in-dryer step of the present process, the cleaning/refreshment composition is releasably absorbed an absorbent substrate, herein after referred to as a "substrate". The substrate releasably contains the composition. By "releasably contains" means that the composition is effectively released from the substrate onto the soiled fabrics as part of the non-immersion cleaning and fabric refreshment processes herein. This release occurs mainly by volatilization of the composition from the substrate through the vapor-permneable coversheet, or by a combination of vapor and liquid transfer, although bulk liquid transfer is desirably minimized by means of the coversheet herein.

The substrate can be in any desired form, such as powders, flakes, shreds, and the like. However, it is highly preferred that the substrate be in the form of an integral pad or "sheet" that substantially maintains its structural integrity throughout the process. The substrates and sheets of this invention are sometimes referred to in the literature as "carriers" or "absorbent carrier sheets"; it is understood that all of these labels refer to liquid absorbing materials that can be used to conveniently transport liquids. Such substrates are described in detail in U.S. Pat No. 5,789,368, to You et al. which was incorporated herein by reference above. The manufacture of these sheets forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, which are incorporated herein by reference.

The substrate is intended to contain a sufficient amount of the cleaning/refreshment composition to be effective for the intended purpose. The capacity of the substrate for such compositions will vary according to the intended usage. The size of the substrate should not be so large as to be unhandy for the user. Typically, the dimensions of the substrate will be sufficient to provide a macroscopic surface area (both sides of the substrate) of at least about 360 $cm^2$, preferably in the range from about 360 $cm^2$ to about 3000 $cm^2$. For example, a generally rectangular substrate may have the dimensions (X-direction) of from about 10 cm to about 35 cm, and (Y-direction) of from about 18 cm to about 45 cm.

Coversheet

The coversheets employed herein are distinguished from the substrate, inasmuch as the coversheets are relatively non-absorbent to the cleaning/refreshment composition as compared with the substrate. The coversheets are constructed from hydrophobic fibers which tend not to absorb, "wick" or otherwise promote the transfer of fluids. While fluids can pass through the void spaces between the fibers of the coversheet, this occurs mainly when excessive pressure is applied to the article. Thus, under typical usage conditions the coversheet provides a physical barrier which keeps the absorbent substrate, which is damp from its load of shrinkage reducing composition and cleaning/refreshment composition, from coming into direct contact with the fabrics being treated. Yet, the coversheet does allow vapor transfer of the shrinkage reducing composition and cleaning/refreshment composition from the substrate through the coversheet and into the containment bag, and thus onto the fabrics being treated. If desired, the coversheet can be provided with macroscopic fenestrations through which the lint, fibers or particulate soils can pass, thereby further helping to entrap such foreign matter inside the article, itself.

Such fibrous, preferably heat resistant and, most preferably, hydrophobic, coversheets are described in detail in U.S. Pat. No. 5,789,368, to You et al. which was incorporated herein by reference above. Additionally, co-pending U.S. provisional application Ser. No. 60/077,556, which was filed on Mar. 11, 1998, in the name of Wise et al., describes certain improvements to the coversheets of this invention. The entire disclosure of the Wise et al. application is incorporated herein by reference. Suitable combinations of the coversheets described in You et al. with the improvements described in Wise et al. can be employed, according to the desires of the manufacturer, without departing from the spirit and scope of the invention.

Spot Cleaning Composition

The user of the present process can be provided with various spot cleaning compositions to use in the optional pre-spotting procedure of this invention. These compositions are used to remove localized stains from the fabrics being treated, either before or after the cleaning and refreshing process defined herein. Necessarily, the spot cleaning composition must be compatible with the fabric being treated. That is, no meaningful amount of dye should be removed from the fabric during the spot treatment and the spot cleaning composition should leave no visible stains on the fabric. Therefore, in a preferred aspect of this invention there are provided spot cleaning compositions which are substantially free of materials that leave visible residues on the treated fabrics. This necessarily means that the preferred compositions are formulated to contain the highest level of volatile materials possible, preferably water, typically about 95%, preferably about 97.7%, and surfactant at levels of about 0.1% to about 0.7%. A preferred spot cleaning composition will also contain a cleaning solvent such as butoxy propoxy propanol (BPP) at a low, but effective, level, typically about 1% to about 4%, preferably about 2%.

Preferred spot cleaning compositions are exemplified below, and are described in U.S. Pat. No. 5,789,368, to You et al. which was incorporated herein by reference above. Additionally, spot cleaning compositions are described in U.S. Pat. No. 5,630,847, which issued on May 20, 1997, to Roetker. The entire disclosure of the Roetker patent is incorporated herein by reference.

Treatment Member

In one embodiment, a treatment member is provided to assist in removing localized stains from fabrics. In a preferred aspect of this invention, the spot cleaning composition is provided in a dispenser, such as a bottle, and the dispenser has a distal tip that can serve as the treatment member. Additionally, the treatment member can comprise an absorbent base material which can be, for example, a natural or synthetic sponge, an absorbent cellulose sheet or pad, or the like. In contact with and extending outward from this base material can be multiple protrusions. Specific examples of treatment members can be found in U.S. Pat. No. 5,789,368, to You et al. which was incorporated herein by reference above.

Absorbent Stain Receiving Article

An absorbent stain receiving article, sometimes referred to herein as a stain receiver, can optionally be used in the optional pre-spotting operations herein. Such stain receivers can be any absorbent material which imbibes the liquid composition used in the pre-spotting operation. Disposable paper towels, cloth towels such as BOUNTY™ brand towels, clean rags, etc., can be used. However, in a preferred mode the stain receiver is designed specifically to "wick" or "draw" the liquid compositions away from the stained area. One preferred type of stain receiver consists of a nonwoven pad, such as a thermally bonded air laid fabric ("TBAI"). Another highly preferred type of stain receiver for use herein comprises polymeric foam, wherein the polymeric foam comprises a polymerized water-in-oil emulsion, sometimes referred to as "poly-HIPE". The manufacture of polymeric foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,550,167 to DesMarais, issued Aug. 27, 1996, and U.S. Pat. No. 5,650,222 to DesMarais et al., issued Jul. 22, 1997, all incorporated herein by reference. Typical conditions for forming the polymeric foams of the present invention are described in co-pending U.S. patent application Ser. No. 09/042,418, filed Mar. 13, 1998 by T. A. DesMarais, et al., titled "Absorbent Materials for Distributing Aqueous Liquids", the disclosure of which is incorporated herein by reference. Additional disclosure of conditions for forming the polymeric foams for use in the present invention are described in co-pending U.S. Provisional Patent Application Serial No. 60/077,955, filed Mar. 13, 1998 by T. A. DesMarais, et al., titled "Abrasion Resistant Polymeric Foam And Stain Receivers Made Therefrom", the disclosure of which is incorporated herein by reference.

The various stain receivers described herein, and described in the references incorporated herein by reference, preferably comprise a liquid impermeable backsheet. The backsheet can be made of, for example, a thin layer of polypropylene, polyethylene and the like. The backsheet provides protection for the surface that the stain receiver rests on from the spot cleaning composition. For example, spot cleaning processes are typically performed on a hard surface, such as a table top. The stain receiver is placed on the table and the fabric to be treated in placed on the stain receiver. Spot cleaning composition is applied to the stained area of the fabric and then drawn into the stain receiver. But in the absence of a back sheet, the spot cleaning composition can leak onto the table top, possibly causing damage thereto.

The following Examples further illustrate the invention, but are not intended to be limiting thereof.

EXAMPLE I

Cleaning and Refreshing Compositions

Fabric cleaning/refreshment compositions according to the present invention, for use in a containment bag, are prepared as follows:

| Ingredient | % (wt.) |
|---|---|
| Emulsifier (TWEEN 20)* | 0.5 |
| Perfume | 0.5 |
| KATHON ® | 0.0003 |
| Sodium Benzoate | 0.1 |
| Water | Balance |

*Polyoxyethylene (20) sorbitan monolaurate available from ICI Surfactants.

Additionally, preferred compositions for use in the in-dryer cleaning/refreshment step of the process herein are as follows.

| Ingredient | % (wt.) | Range (% wt.) |
|---|---|---|
| Water | 99.0 | 95.1–99.9 |
| Perfume | 0.5 | 0.05–1.5 |
| Surfactant* | 0.5 | 0.05–2.0 |
| Ethanol or Isopropanol | 0 | Optional to 4% |
| Solvent (e.g. BPP) | 0 | Optional to 4% |

pH range from about 6 to about 8.

Besides the other ingredients, the foregoing compositions can contain enzymes to further enhance cleaning performance, as described in the Trinh et al. patent incorporated herein above.

EXAMPLE II

Preparation Of A Substrate Comprising A Cleaning/Refreshment Composition

A 10 ¼ in.×14 ¼ in. (26 cm×36 cm) substrate in the form of a sheet is prepared from HYDRASPUN® material, manufactured by the Dexter Corp. The substrate sheet is covered on both sides with a topsheet and a bottomsheet of 8 mil (0.2 mm) Reemay fabric coversheet material. The coversheet (i.e., both topsheet and bottomsheet) are bonded to the substrate sheet by a Vertrod® or other standard heat sealer device, such as conventional sonic sealing devices, thereby bonding the laminate structure together around the entire periphery of the sheet. The edges of the sheet around its periphery are intercalated between the topsheet and bottomsheet by the bond. As noted above, the width of the bond is kept to a minimum and is about 0.25 in. (6.4 mm).

The bonded laminate sheet thus prepared is folded and placed in a pouch. Any plastic pouch which does not leak would be suitable. For example, a foil laminated pouch of the type used in the food service industry can be employed. Such pouches are well-known in the industry and are made from materials which do not absorb food flavors. In like manner, the formulator herein may wish to avoid absorption of the perfume used in the cleaning/refreshment composition by the pouch. Various pouches are useful herein and are commercially available on a routine basis.

The folded substrate/coversheet sheet is placed in the pouch. The folds can be of any type, for example, an accordion-style fold or rolled and then the roll is folded in half. This size is not critical but is convenient for placement in a pouch.

5 grams of a shrinkage reducing composition and 18 grams of the cleaning/refreshment composition are poured onto the substrate sheet/coversheet in any order, more preferably the shrinkage reducing composition and the cleaning/refreshment composition are mixed before pouring onto the substrate. The compositions are allowed to absorb into the substrate. The pouch is sealed immediately after the liquid product is introduced into the pouch and stored until time-of-use.

EXAMPLE III

Spot Cleaning Compositions

A spot cleaning composition for use for use in the present invention, preferably with a dispenser as defined above, and with a TBAL, or poly-HIPE foam stain receiver, is prepared as follows:

| INGREDIENT | % (Wt.) (Nonionic) | Range % (Wt.) |
|---|---|---|
| Hydrogen peroxide | 1.000 | 0–2 |
| Amino tris(methylene phosphonic acid)* | 0.040 | 0–0.06 |
| Butoxypropoxypropanol (BPP) | 2.000 | 1–6 |
| Neodol 23 6.5 | 0.250 | 0–1 |
| Kathon preservative | 0.0003 | Optional** |
| Water | 96.710 | Balance |

pH target = 7; range = 6–8
*Stabilizer for hydrogen peroxide
**Sufficient to provide a preservative function.

Another example of a preferred, high water content, low residue spot cleaning composition for use in the pre-spotting step herein is as follows.

| INGREDIENT | Anionic Composition (%) |
|---|---|
| Hydrogen peroxide | 1.000 |
| Amino tris(methylene phosphonic acid)* | 0.0400 |
| Butoxypropoxypropanol (BPP) | 2.000 |
| $NH_4$ Coconut $E_1S$ | 0.285 |
| Dodecyldimethylamine oxide | 0.031 |
| Magnesium chloride | 0.018 |
| Magnesium sulfate | 0.019 |
| Hydrotrope, perfume, other minors, | 0.101 |
| Kathon preservative | 0.0003 |
| Water (deionized or distilled) | 96.507 |
| Target pH | 6.0 |

*Stabilizer for hydrogen peroxide

Preferably, to minimize the potential for dye damage as disclosed hereinabove, $H_2O_2$-containing pre-spotting compositions comprise the anionic or nonionic surfactant in an amount (by weight of composition) which is less than the amount of $H_2O_2$. Preferably, the weight ratio of surfactant:$H_2O_2$ is in the range of about 1:10 to about 1:1.5, most preferably about 1:4 to about 1:3.

What is claimed is:

1. A vapor-venting containment bag comprising a bag material having one or more fold lines inscribed thereon, an opening and a fastening means for closing the bag, wherein the bag comprises:

i) a folded configuration when the bag material is folded along one or more of the fold lines;

ii) a closed configuration when the bag material is in its folded configuration and the fastening means substantially closes the opening, thereby the bag defines a three dimensional interior void space; and iii) a VVE rating of from about 40 to about 90, as measured in the Vapor Venting Evaluation Test.

2. The bag according to claim 1 further comprising an unfolded configuration when the bag material is not folded along one or more of the fold lines.

3. The bag according to claim 1 wherein the bag has a VVE rating of from about 60 to about 90.

4. The bag according to claim 1 wherein the bag has a VVE rating of from about 60 to about 80.

5. The bag according to claim 1 wherein the bag material is heat resistant up to at least about 260° C.

6. The bag according to claim 1 wherein the bag material comprises a single-layer sheet, a multi-layer sheet, or a nonwoven/sheet combination.

7. The bag according to claim 1 wherein the bag material comprises a polymer selected from the group consisting of nylon, polyester, polyethylene terephthalate, polyprpopylene, and combinations thereof.

8. The bag according to claim 1 wherein the fastening means is a vapor-venting fastener.

9. The bag according to claim 1 wherein the fastening means comprises a first fastening device and a second fastening device.

10. The bag according to claim 1 wherein the fastening means is selected from the group consisting of mechanical fasteners, chemical fasteners, hook fasteners, hook and loop fasteners, hook and string fasteners, toggle-type fasteners, snap-type fasteners, hook and eye fasteners, ZIP LOK®-style fasteners, and zipper-type fasteners.

11. The bag according to claim 1 wherein the folded configuration comprises a three dimensional structure having flexible side walls.

12. The bag according to claim 1 wherein the folded configuration comprises a three dimensional structure having at least three side walls.

13. The bag according to claim wherein the folded configuration comprises a three dimensional structure having at least four side walls.

14. The bag according to claim 1 wherein the folded configuration comprises a three dimensional structure having at least six side walls.

15. A process for cleaning or refreshing a fabric article comprising the steps of:

providing a vapor-venting containment bag according to claim 1;

adding a fabric cleaning/refreshment composition and the fabric article to be cleaned or refreshed to the interior void space of the bag; and raising a temperature surrounding the bag or the fabric article to from about 40° C. to about 150° C. and venting malodors presented by the fabric article from the bag.

16. The process according to claim 15 wherein the process is conducted in a hot air clothes dryer.

17. A kit for cleaning or refreshing a fabric articles comprising:

(a) one or more absorbent articles comprising a carrier which releasably contains water and optional non-water fabric cleaning/refreshment ingredients; and (b) a vapor-venting containment bag according to claim 1.

18. The kit according to claim 17 wherein the absorbent articles are disposable after a single use.

19. The kit according to claim 17 wherein the bag is durable.

* * * * *

UNITED STATES PATENT AND TRADEMARK OFFICE

CERTIFICATE OF CORRECTION

PATENT NO. : 6,684,440 B1
DATED : February 3, 2004
INVENTOR(S) : Rodney Mahlon Wise It is certified that error appears in the above-identified patent and that said Letters Patent is hereby corrected as shown below:

Column 18,
Line 10, please replace "The bag according to claim wherein", with -- The bag according to claim 1 wherein --

Signed and Sealed this

Eighteenth Day of May, 2004

JON W. DUDAS
*Acting Director of the United States Patent and Trademark Office*